US007360720B2

(12) United States Patent
Göhring et al.

(10) Patent No.: US 7,360,720 B2
(45) Date of Patent: Apr. 22, 2008

(54) SPRAY GUN

(75) Inventors: Alfred Göhring, Salem (DE); Peter Ibele, Horgenzell (DE); Andreas Kramer, Markdorf (DE); Jens Ulbrich, Friedrichshafen (DE)

(73) Assignee: J. Wagner GmbH, Markdorf (DE)

( * ) Notice: Subject to any disclaimer, the term of this patent is extended or adjusted under 35 U.S.C. 154(b) by 264 days.

(21) Appl. No.: 11/143,283

(22) Filed: Jun. 2, 2005

(65) Prior Publication Data

US 2005/0269425 A1 Dec. 8, 2005

(30) Foreign Application Priority Data

Jun. 4, 2004 (DE) ..... 10 2004 027 551

(51) Int. Cl.
*B05B 7/30* (2006.01)
*B05B 1/28* (2006.01)

(52) U.S. Cl. ..... 239/351; 239/315; 239/316; 239/135; 239/290; 239/415; 239/375; 118/300; 427/421

(58) Field of Classification Search ..... 239/302, 239/310, 315, 316, 375, 378, 290–301, 433, 239/454, DIG. 14, 525–531; 222/323–324, 222/630–31, 704, 251, 390–409, 335, 372; 432/219, 232, 421, 222
See application file for complete search history.

(56) References Cited

U.S. PATENT DOCUMENTS 3,900,165 A 8/1975 Parke et al. ..... 239/375
4,256,241 A 3/1981 Mesic ..... 222/85

(Continued)

FOREIGN PATENT DOCUMENTS

FR 2485400 12/1981

(Continued)

*Primary Examiner*—Dinh Q. Nguyen
*Assistant Examiner*—James S. Hogan
(74) *Attorney, Agent, or Firm*—Pandiscio & Pandiscio

(57) ABSTRACT

In a spray gun (1) for atomizing fluids, that can be actuated using a lever (15) mounted in a pivoting arrangement on a sleeve (11) which accommodates an atomizer nozzle (12) and in which the air flow can be generated by an air turbine (5) that is assigned to the spray gun (1), the air turbine (5) and its electric drive motor (4) are arranged substantially coaxially to the sleeve (11) on the opposite side of a handle (21) and the air flow is supplied from the air turbine (5) in a substantially straight line through the sleeve (11) of the atomizer nozzle (12). The air turbine (5) is provided with a muffler (6). Loud operating noise of the air turbine (5) does not have a disruptive effect and practically no flow noise is generated due to deflections of the air flow. The components of the spray gun (1) are arranged in such a way that no more than slight tilting torques are generated, permitting work over long periods without leading to fatigue.

25 Claims, 6 Drawing Sheets

U.S. PATENT DOCUMENTS

| | | | | |
|---|---|---|---|---|
| 4,555,232 | A | 11/1985 | Raccah et al. | 432/222 |
| 4,726,767 | A | 2/1988 | Nakajima | 432/222 |
| 4,928,883 | A | 5/1990 | Weinstein | 239/223 |
| 5,009,592 | A | 4/1991 | Roldan et al. | 432/222 |
| 5,344,314 | A | 9/1994 | Zagoroff et al. | 432/222 |
| 5,452,855 | A | 9/1995 | Keller | 239/135 |
| 5,550,335 | A | 8/1996 | Ermert et al. | |
| 6,959,707 | B2 | 11/2005 | Fujiwara | 126/401 |
| 6,983,550 | B1 | 1/2006 | Lin | 34/96 |
| D519,603 | S | 4/2006 | Schumann et al. | D23/225 |

FOREIGN PATENT DOCUMENTS

| | | | |
|---|---|---|---|
| FR | 2485400 | A | 12/1981 |
| GB | 2 142 559 | A | 1/1985 |
| WO | WO 03/051525 | | 6/2003 |

Fig. 5
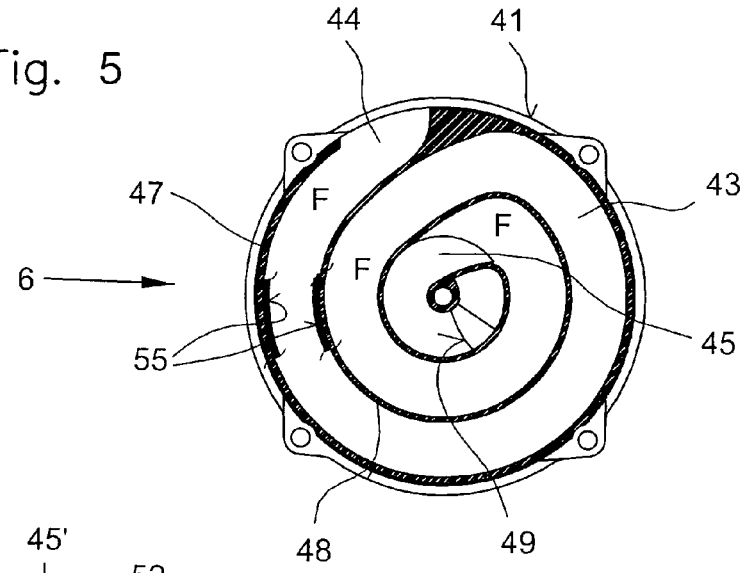
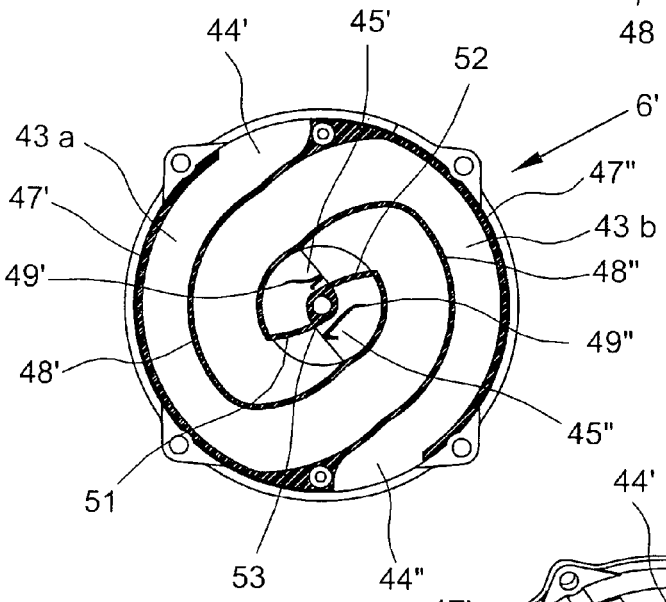
Fig. 6
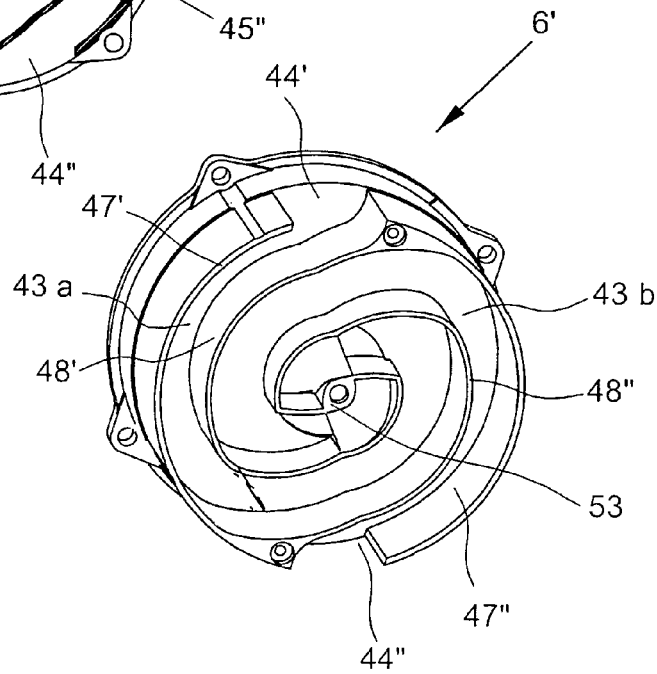
Fig. 7

SPRAY GUN

BACKGROUND OF THE INVENTION

1. Field of the Invention

The present invention relates to a spray gun for atomizing paints, lacquers or similar media that can be supplied to a workpiece by means of an air flow, in which case the spray gun can be actuated by means of a lever mounted in a pivoting arrangement on a sleeve which accommodates an atomiser nozzle and the air flow can be generated by an air turbine assigned to the spray gun.

2. Description of the Prior Art

A spray gun of this type is described in FR 80 145 66. In this embodiment, the electric motor driving the air turbine can be removed together with the air turbine and is arranged in a separate component on the housing of the spray gun perpendicular to the atomizer nozzle of the spray gun, so that the air flow generated by the air turbine has to have its direction changed several times before it emerges from the atomizer nozzle.

This generates significant flow noise as well as flow losses, therefore this spray gun does not provide a reasonable level of efficiency. A further disadvantage is that the drive motor of the air turbine is only provided with inadequate cooling; this is because the only air flowing past the drive motor is the air drawn in by the air turbine and this air flow is not controlled, meaning that sustained operation is often impossible. Also, this spray gun does not provide any counterbalance because the reservoir container for the medium to be processed and the drive motor with air turbine are arranged ahead of the handle, therefore a high tilting torque is generated whilst the medium is being processed and this tilting torque has to be counteracted by the operating personnel. The principal disadvantage, however, is that the level of noise generated by the air turbine spinning at high speed is only inadequately muffled by the component that houses the motor. As a result, this spray gun has not proved effective in practical use.

The purpose of the present invention is therefore to create a spray gun for atomising medium of the aforementioned type that not only has a straightforward design structure and can be easily operated, but in which above all the operating noise does not attain disruptive levels and there are almost no flow losses which would be caused by changes in the direction of the air flow. Furthermore, the components of the spray gun should be distributed in such a way that either no or only slight tilting torques are generated, therefore permitting work over long periods without leading to fatigue.

In accordance with the present invention, this is achieved in a spray gun of the aforementioned type in that the air turbine and its electric drive motor are arranged coaxially or almost coaxially to the atomiser nozzle of the spray gun on the side of a handle opposite to the sleeve that carries the atomiser nozzle so that the air flow from the air turbine can be supplied in or almost in a straight line through the sleeve of the atomiser nozzle and that the air turbine is provided with a muffler.

In this case, it is advantageous for the muffler, the air turbine and its drive motor to be arranged axially one after the other in the flow direction of the air flow and installed in an attachment formed onto or attached to the handle, so that a high counterweight to the reservoir container attached on the opposite side of the sleeve is created. In addition, a cavity should be provided between the muffler and the air turbine by means of which the flow noise is reduced.

Furthermore, it is advantageous for the movement sequence of the lever that actuates the spray gun to be adapted to a switch associated with the drive motor of the air turbine and that can be influenced by the lever in such a way that the drive motor can be switched on before the atomiser nozzle opens and can be switched off after the atomiser nozzle closes. In this way, it is assured that the medium will only be sprayed when sufficient air flow is available for this and no droplets will be formed when the spray gun is switched on and off.

In order to avoid deflections in the air flow within the spray gun and therefore to avoid flow losses, the attachment that accommodates the muffler, the air turbine and its drive motor should be arranged at an angle $\alpha$ from 0° to 60°, in a preferred embodiment approx. 20°, in relation to the longitudinal axis of the sleeve that carries the atomiser nozzle, opposite to the handle.

Furthermore, the drive motor of the air turbine should be equipped with a jacket that is closed in the axial direction and radially supported in the attachment, it being possible for this jacket to be connected to the sleeve with a connection that can, in a preferred embodiment, be separated. The jacket therefore forms a pressure chamber through which the air flow is guided close to the drive motor of the air turbine so the air flow provides effective cooling.

In accordance with a further embodiment, there is provision for installing a protective grille between the drive motor of the air turbine and the sleeve, with the protective grille being supported, in a preferred embodiment, in the jacket and which should be manufactured from a vibration-damping material, with the possibility of mounting the end of the drive motor of the air turbine that faces away from the air turbine in the protective grille. As a result, satisfactory support for the drive motor is assured.

It has also proven to be extremely advantageous to form the attachment and/or the jacket directly onto the handle and, with a separable connection, on the sleeve that carries the atomiser nozzle, for example by means of a bayonet lock, in which case a container cover can be attached to the sleeve and the container cover should be provided with a holding element, for example in the form of a lug, into which it is possible to engage a web projecting from the handle in order to lock the connection between the attachment or the jacket and the sleeve. In this way, it is possible for the drive part of the spray gun to be separated from its components that are used for atomisation and for the air flow to be used for other purposes, e.g. as a jet of air for blowing out workpieces.

It is also advantageous for the end of the handle to run in the same plane as the standing surface of a reservoir container attached to the spray gun and if the end of the handle is formed as a stand foot, so that the spray gun can be securely put down after use. To reduce the operating noise of the air turbine even more, a sound-absorbing insert should also be arranged between the attachment and the jacket of the drive motor.

The muffler used in the spray gun in accordance with the present invention is, in order to achieve effective acoustic insulation of the intake noise of the air turbine, characterized in that the muffler has a spiral-shaped air duct arranged in a cylindrical housing between an air inlet opening and an air outlet opening, this air duct being formed by two thin-walled partition walls that run in a spiral and are arranged at a lateral distance from one another on a base and/or on a cover of the housing that, in a preferred embodiment, is cylindrical in shape and which project at right angles from the housing, these partition walls combining with the base and the cover to enclose a closed cross-sectional area, that the air inlet opening of the air guide duct is worked into the outer wall of the housing and/or the cover, for example in the form of slots, and that the air outlet opening is arranged centrally in the housing in the base of the housing.

In this case, it is advantageous for the air guide duct to consist of two or more sections running in an almost mirror image arrangement to one another and, in a preferred embodiment, with point symmetry so that the air supply can be evenly distributed over 360°.

Furthermore, it is advantageous for the air guide duct or the two sections that form the air guide duct to be provided with a guide surface in the area of the air outlet opening, the guide surface being spatially curved, and in the case that the air guide duct is composed of two or more sections then the individual sections in the area of the air outlet opening are to be separated from one another by wall sections extending in the axial direction of the air guide duct.

Furthermore it is advantageous for the cross-sectional area of the air guide duct or the sections that form it to be always consistent along its length, in which case if the base and/or the cover of the housing are configured with a funnel shape then the distance between the two partition walls enclosing the air guide duct or enclosing the sections forming the air guide duct is continuously changed in such a way that the enclosed cross-sectional area of the air guide duct is kept constant at all times.

In particular in a housing with a tapered base, the air outlet opening should be followed by an air distributor in the form of a guide body with a tapered configuration.

The housing and/or the cover and the partition walls formed onto them should be configured as an injection-moulded plastic part, in which case it is advantageous for the housing and/or the cover and/or the partition walls formed onto them to be manufactured from a plastic which absorbs or reflects sound, in a preferred embodiment from a plastic incorporating air bubbles and/or pores and, furthermore for the housing and/or the cover and/or the partition walls to be provided with a coating which absorbs and/or reflects sound.

If the partition walls that form the air guide duct are formed onto the base of the housing then it is advantageous for a preferably rubber-like seal to be inserted between them and the cover, the seal corresponding approximately to the inner jacket surface, or for the seal to be attached to the cover.

In order to reduce the noise additionally, it is advantageous for one or more air inlet openings to be provided, e.g. in the form of slots, in the attachment of the spray gun, with the air inlet openings being arranged in a preferred embodiment offset at 90° or 180° in the circumferential direction and/or axially displaced in relation to the air inlet openings worked into the housing and/or the cover of the muffler.

The muffler embodied in accordance with the present invention can form the end air connection of the air turbine and be arranged directly in its intake area.

In a spray gun is embodied in accordance with the present invention, it is possible to atomise a medium with the help of a high-volume air jet without thereby giving rise to unpleasant noise or impeding the handling of the spray gun. The air flow is namely guided almost in a straight line through the attachment accommodating the air turbine as well as the sleeve that carries the atomiser nozzle, there are no deflections in the air flow and the flow resistance values are also minor.

Furthermore, it is advantageous that the arrangement of the sleeve with the atomiser nozzle and the reservoir container on one side of the handle and of the attachment accommodating the air turbine and the drive motor on the other side of the handle provides for an almost even distribution of weight. It is therefore possible to work with the spray gun configured in accordance with the present invention for long periods without uneven loadings leading to fatigue. Also, in particular in the separable embodiment of the spray gun, the spray gun can be used for many different applications by connecting a hose with an air nozzle, for example, to the air turbine in order to be able to perform cleaning work.

The muffler assigned to the air turbine furthermore permits a very effective insulation of the intake noise of the air turbine, since the sucked-in air flow is if necessary divided into several individual flows, sucked in over a long distance and only deflected to a minimum extent in this case. The resistance opposing the sucked-in air is only minor in this case, therefore the air flow rate through the muffler is only impeded to a slight extent.

The thin-walled partition walls forming the air guide duct furthermore only take up a minor proportion of the interior of the housing, so that almost the entirety of the housing can be used for the air flow. Also, the partition walls formed onto the base and/or the cover and contacting the opposite part ensure a high level of stability, by means of which the noise is further reduced. When the muffler in accordance with the present invention is used, it is therefore possible significantly to reduce the environmental impact resulting from the use of the high speed air turbines which generate loud noise.

BRIEF DESCRIPTION OF THE DRAWINGS

The drawings show sample embodiments of a spray gun configured in accordance with the present invention, the details of which are explained below. In the drawings.

FIG. 5 shows an axial section of a muffler installed in the spray gun in accordance with FIG. 1, with a one-piece air guide duct;

FIG. 6 shows the spray gun in accordance with FIG. 5, with an air guide duct formed from two sections;

FIG. 7 shows a perspective view of the muffler in accordance with FIG. 6;

DESCRIPTION OF THE PREFERRED EMBODIMENTS

Figure 1:
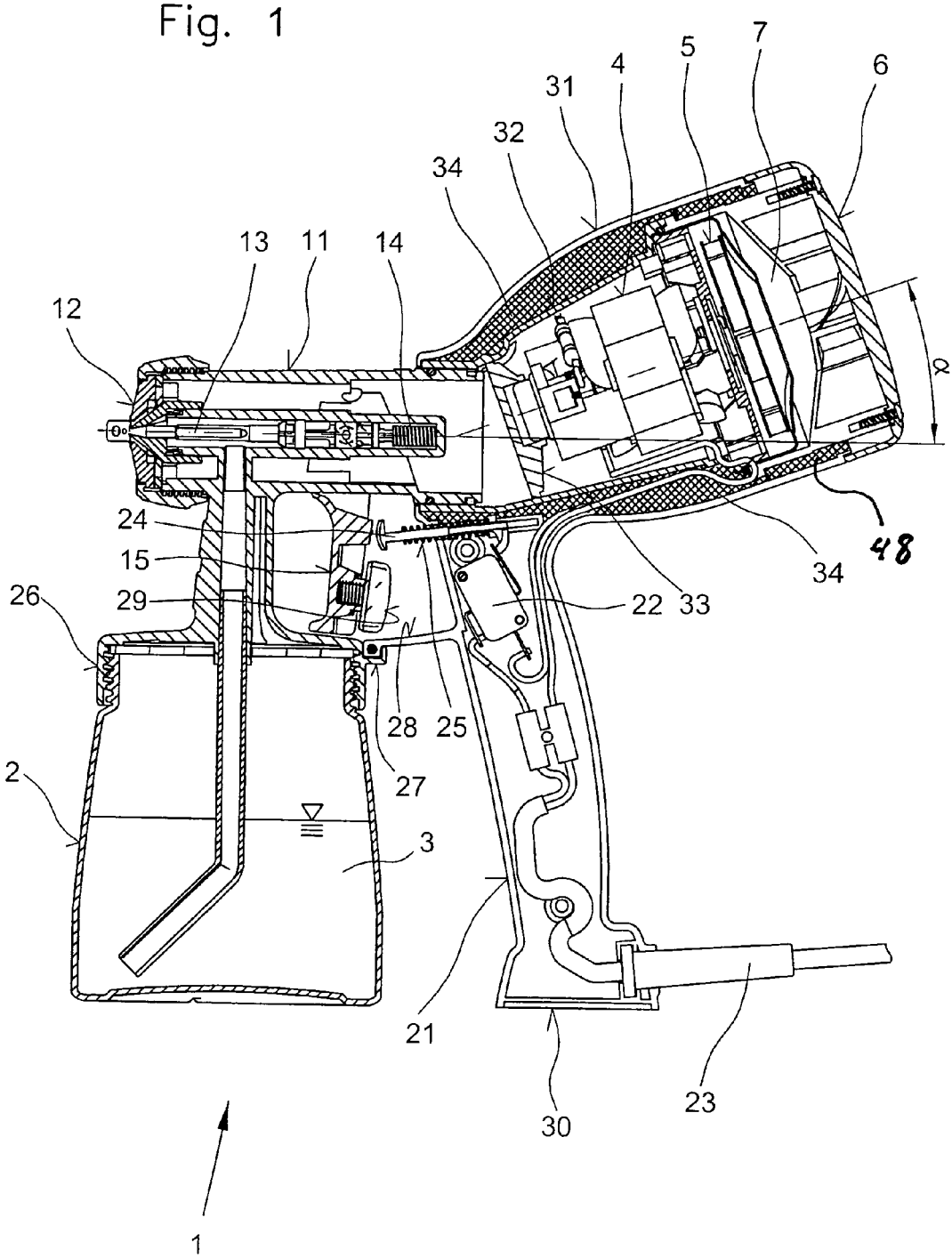
FIG. 1 shows a longitudinal section through the spray gun with atomizer nozzle, air turbine and muffler.

The spray gun shown in FIGS. 1, 2, 3 and 4 and identified with 1 or 1' is used for atomising paints, lacquers or similar media 3 located in a reservoir container 2, it being possible to supply the media 3 to a workpiece by means of an air flow. In the illustrated embodiment, the air flow for atomisation is generated by an air turbine 5 that can be driven by an electric motor 4. In addition, the air turbine 5 is provided with a muffler 6 in order to reduce the intake noise, whilst a cavity 7 is created between the muffler 6 and the air turbine 5 for the same purpose.

The spray gun 1 principally consists of a sleeve 11 to which the reservoir container 2 is attached, of an atomiser nozzle 12 equipped with an axially adjustable nozzle needle 13 and also attached to the sleeve 11, of a handle 21 and of an attachment 31 formed onto the handle 21, the attachment 31 being firmly connected to the sleeve in the case of the spray gun 1 and which accommodates the air turbine 5, its drive motor 4 and the muffler 6. The spray gun can be actuated by means of a lever 15 that operates against the force of a spring 14 and that pivots about an articulated pin 16.

The handle 21 has an electrical switch 22 built into it, to which electrical power can be supplied through a cable 23 and that is inserted in the circuit of the electric motor 4. By means of a button 24 that can also be moved by the lever 15 against the force of a spring 25, it is possible to switch the circuit of the electrical motor 4 in such a way that the air turbine 5 is switched on before the atomiser nozzle 12 opens and for the air turbine 5 only to be switched off once the atomiser nozzle 12 has itself already been closed.

Figure 2:
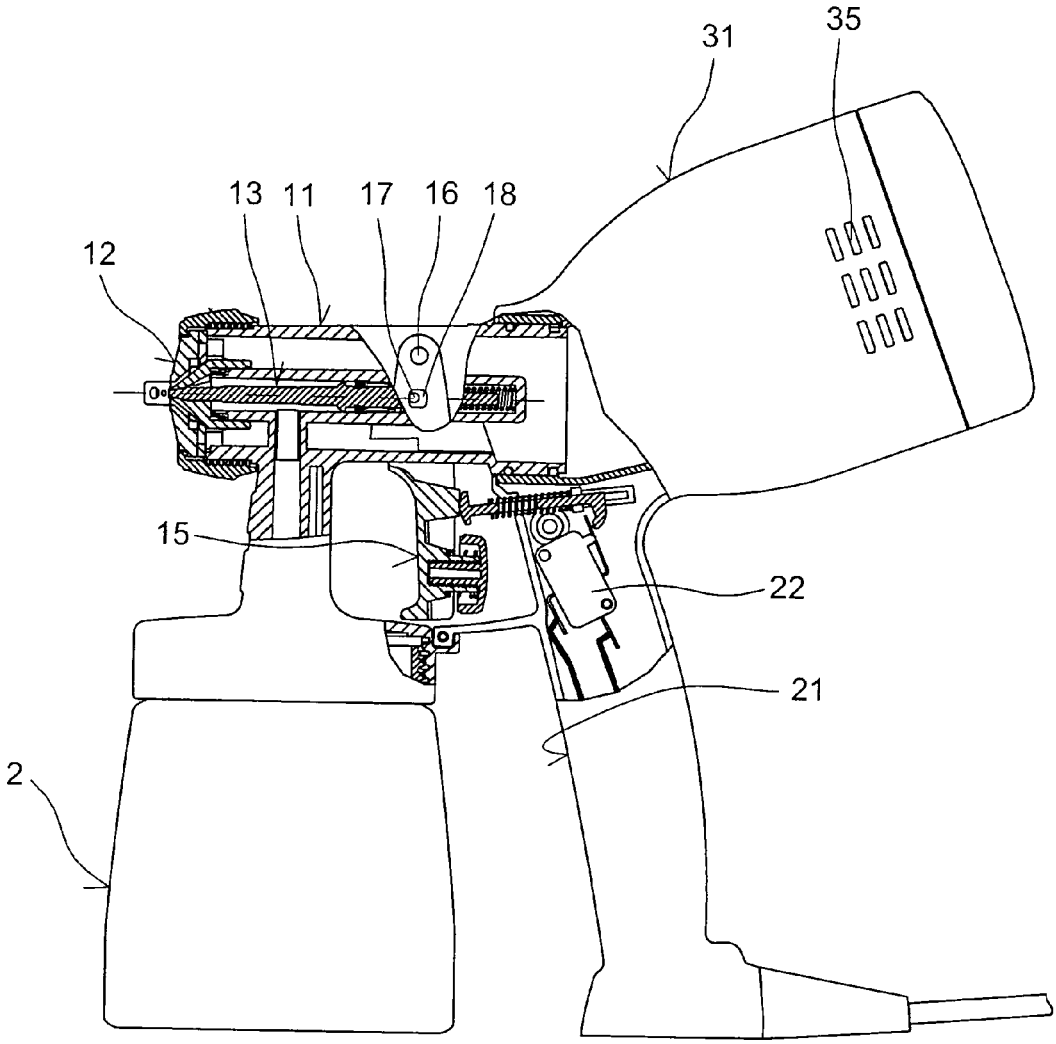
FIGS. 2 and 3 each show a partial section through the spray gun in accordance with FIG. 1 in various operation positions.
Figure 3:
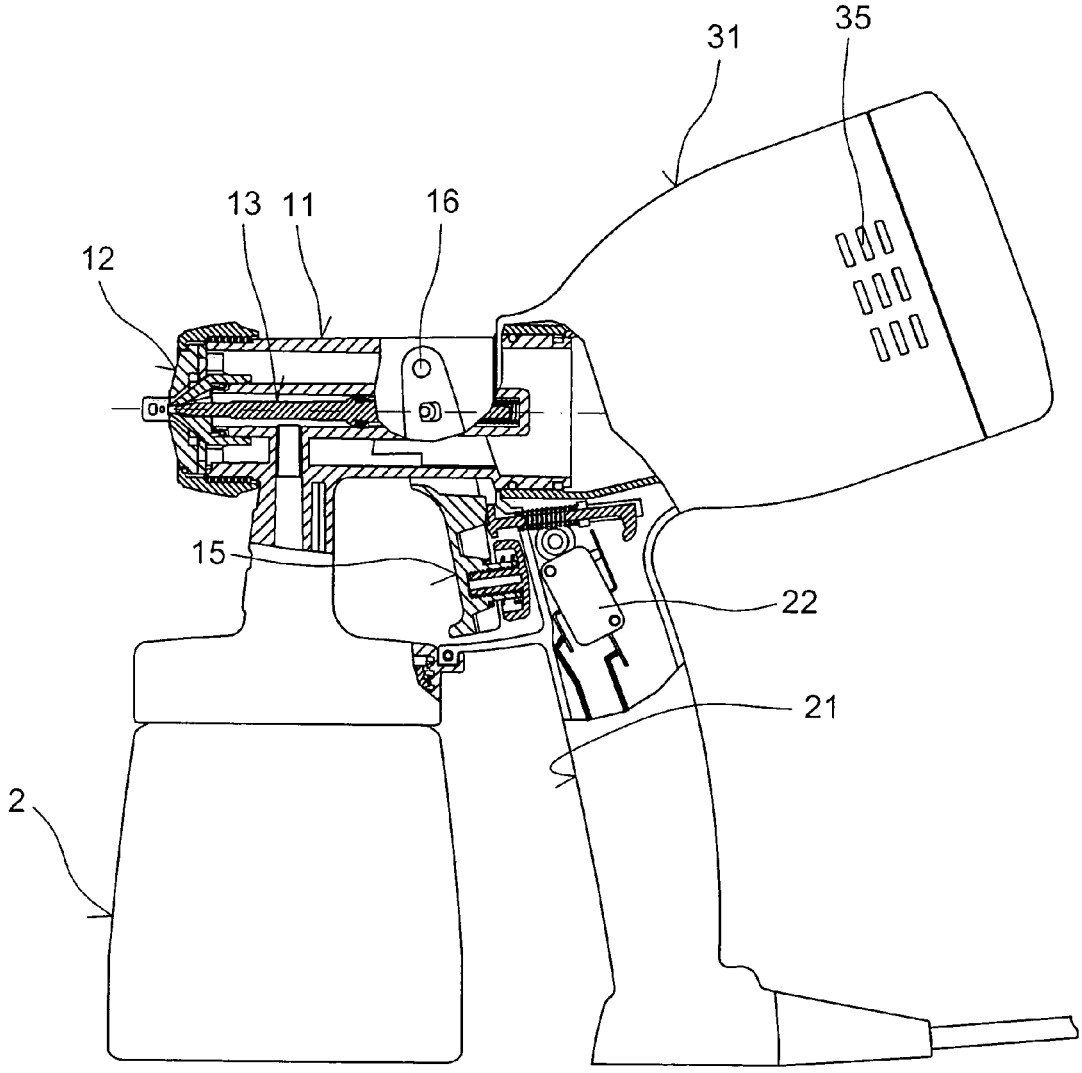

For this purpose and as shown in the various operating positions in FIGS. 1, 2 and 3, the operating sequence of the lever 15 is accordingly adapted to the movement of the nozzle needle 13 and the button 24 for switching the drive motor 4 on and off. This approach avoids a situation in which the medium 3 can emerge from the atomiser nozzle 12 before a sufficient air flow is available for processing it, or that droplets are formed on the atomiser nozzle 12 before the start of work or after work has finished.

In order to make this movement sequence possible, a slot 18 is worked into the lever 15 of which the adjustment travel is to be adjusted using a setscrew 29 at the level of the nozzle needle 13, and a pin 17 attached to the nozzle needle 13 engages in the slot 18. The nozzle needle 13 is therefore not entrained and moved until the drive motor 4 has already been switched on by the actuation of the switch 22, due to the necessity of overcoming the idle travel created by the slot 18.

The drive motor 4 and the air turbine 5 that spins at high speed are inserted in a jacket 32 that, in the embodiment illustrated in FIGS. 1 to 3, is firmly connected to the sleeve 11 together with the attachment 31. The jacket 32 therefore forms a pressure chamber for the air flow generated by the air turbine 5 that is guided past the drive motor 4 and provides cooling for the drive motor 4. Furthermore, the jacket 32 accommodates a protective grille 33 made from a vibration-damping material that is supported on the jacket 32 and in which is mounted the end of the drive motor 4 opposite to the air turbine 5. An insert 34 made from a sound-absorbing material is arranged between the jacket 32 and the attachment 31, and this insert 34 significantly insulates the noise created by the air flowing into the sleeve 11 through the protective grille 33 in the suction and pressure area.

In order to increase the stability of the connection between the sleeve 11 and the attachment 31 or the jacket 32, a lug 27 is attached to a cover 26 formed onto the sleeve 11, this cover 26 being for the container 2 that is held in a separable connection, and a web 28 projects from the handle 21 and is engaged in the lug 27. Furthermore, the end of the handle 21 at the level of the base of the container 2 is formed as a stand foot 30 so that the spray gun can be put down securely.

Since the attachment 31 is located at an angle $\alpha$ of approx. 20° upwards in relation to the sleeve, the air flow generated by the air turbine 5 travels into the sleeve 11 and therefore into the atomiser nozzle 12 almost without any deflection. As a result, flow losses and flow noise are largely avoided. Also, the insert 34 and the muffler 6 keep the operating noise of the spray gun 1 within a range that can be supported by the operating personnel in spite of the fact that the air turbine 5 is rotating at high speed.

Figure 4:
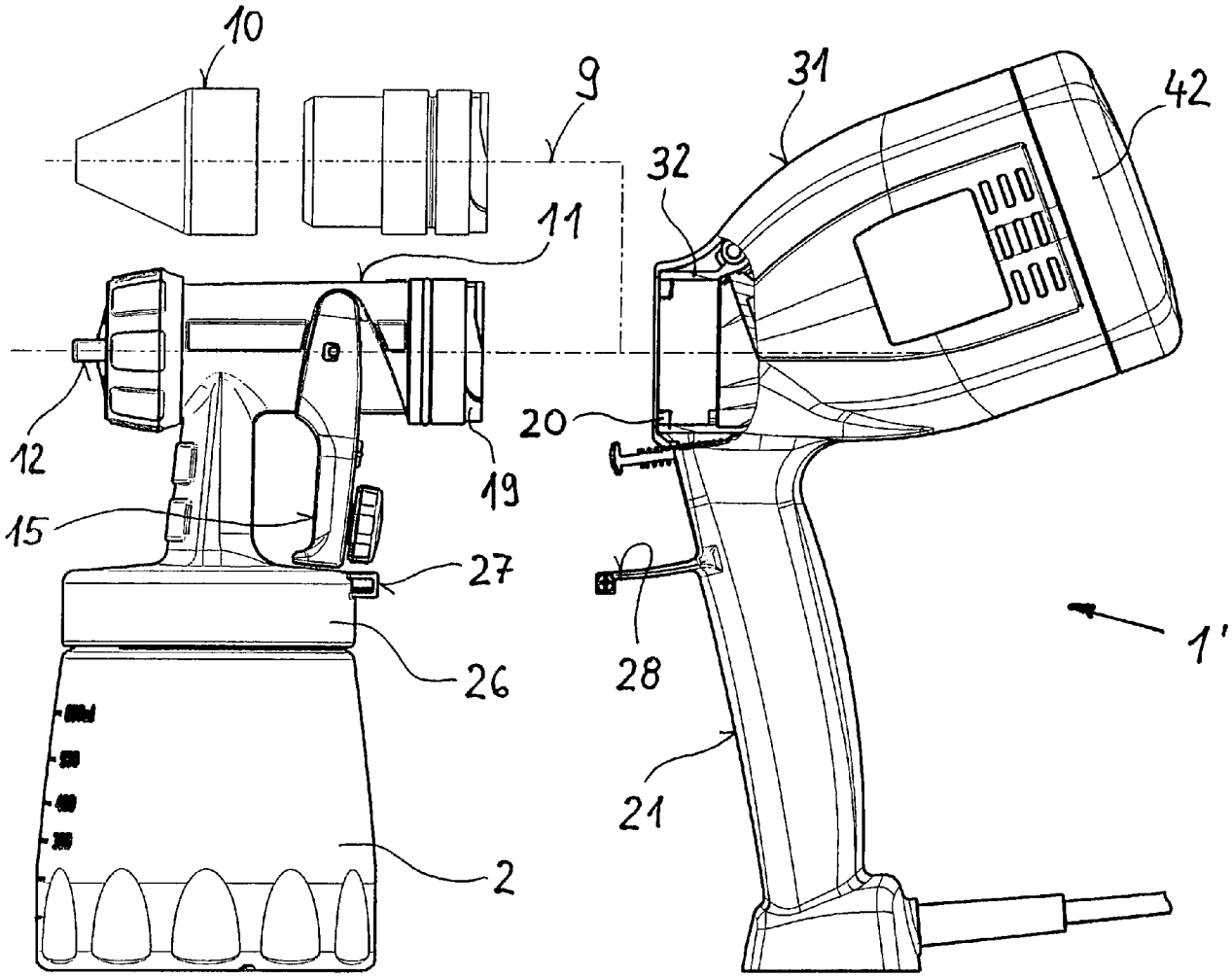
FIG. 4 shows a projection of a variant of the spray gun in accordance with FIG. 1, in a separable embodiment.

In the embodiment illustrated in FIG. 4, the handle 21 and the attachment 31 are both connected to the sleeve 11 in a separable arrangement. A bayonet lock 19 and 20 is used for this purpose, with its interlocking components being formed onto the sleeve 11 and the jacket 32. As a result, a hose line 9 can be connected to the jacket 32, there being an air nozzle 10 connected to the hose line 9. In this way, the air flow generated by the air turbine 5 can be used for blowing out workpieces, for example.

The muffler 6 used in the spray gun 1 or 1' consists, as can be seen in detail in particular in FIGS. 5 to 9, of a cylindrical housing 41 and a cover 42 on the housing 41, with the interior of the muffler 6 featuring an air guide duct 43 that is formed by thin-walled partition walls 47 and 48 arranged at a lateral distance from one another. The partition walls 47 and 48 are formed onto a base 46 of the housing 41 and/or on the cover 42 and project at right angles from it. In addition, the air guide duct 43 is equipped with an air inlet opening 44 worked directly into the outer wall of the housing 41 and an air outlet opening 45 provided centrally in relation to the base 46. In the muffler as illustrated in FIG. 5, the air outlet opening 45 is provided with a spatially curved guide surface 49 in order to deflect the air flow and direct it towards the air turbine 5.

In the embodiment shown in FIGS. 6 and 7, the air guide duct 43 is formed by two sections 43*a* and 43*b* in an almost mirror-image arrangement, which are therefore arranged in point symmetry to one another. Accordingly, two air inlet openings 44' and 44" are worked into the outer wall of the housing 41 and the air outlet openings 45' and 45" are in turn provided with guide surfaces 49' and 49". In addition, the sections 43*a* and 43*b* are separated from one another in the area of the air outlet openings 45' and 45" by means of two wall sections 51 and 52 that are connected to one another by a hub 53, with the effect that the two air flows to be supplied to the air turbine 5 via the sections 43*a* and 43*b* do not come together in the area of the air outlet openings 45' and 45".

The cross-sectional area F of the air guide duct 43 in the muffler 6 is always the same along its length. However, in the muffler 6' shown in FIG. 8, the base 46 of the housing 41 has a tapering shape, therefore the distance between the two partition walls 47' and 48' or 47" and 48" has to change continuously in order to keep the same cross-sectional area F in both sections 43*a* and 43*b* at all times. The increase in the axial distance between the base 46 and the cover 42 in the outer area compared to the inner area is therefore compensated for by a reduction in the lateral clearance between the partition walls 47' and 48' or 47" and 48".

Figure 9:
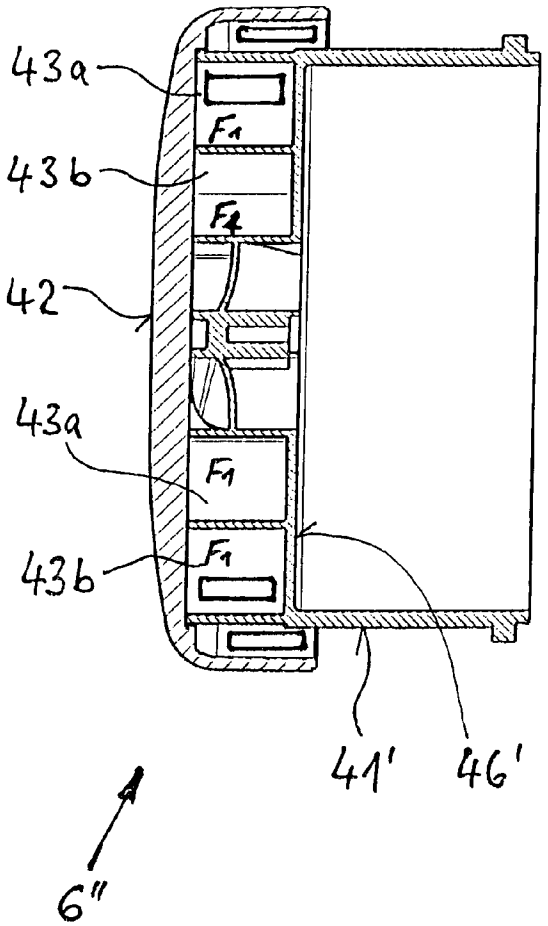
FIG. 9 shows the muffler in accordance with FIG. 8, with sections of the air guide duct having different cross sections.

In the muffler 6" shown in FIG. 9, in contrast, the base 46' of the housing 41' runs in parallel to the cover 42. The distance between the partition walls 47' and 48' or 47" and 48" is therefore also constant in order to achieve a constant cross-sectional area $F_1$.

Figure 8:
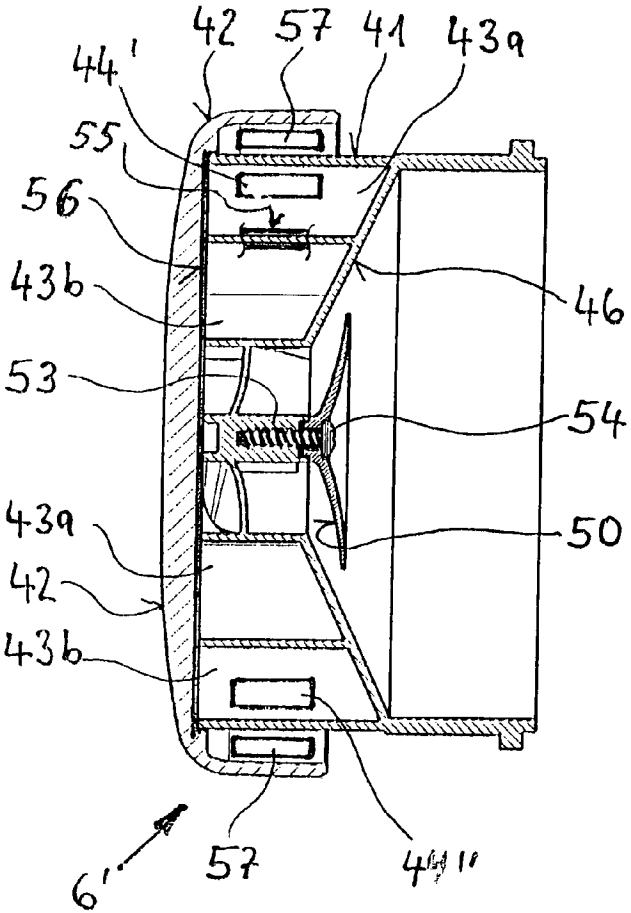
FIG. 8 shows an axial section through the muffler in accordance with FIG. 7.

In accordance with FIG. 8, the air outlet opening 45', 45" can be followed by a tapering air body 50 that is attached to the hub 53 by means of a screw 54, in order to deflect the air flow radially outwards and to insulate noise. Furthermore, the partition walls 47, 48 can be provided with a sound-absorbing coating 55 and a rubber-like seal 56 can be inserted between the partition walls 47, 48 and the cover 42 in order to provide an air-tight seal in the air guide duct 43 or the sections 43*a*, 43*b* in the area of the cover 42. In addition, an air filter 58 can be inserted between the rotating edge of the cover 42, in which air slots 57 can be worked, and the housing 41.

In the spray gun 1, the air for generating a high-volume air flow is supplied to the muffler 6 through air inlet openings 35 worked into the attachment 31. The air inlet openings 35 in this case are offset in relation to the air inlet openings 44 of the muffler both around the circumference and in the axial direction of the attachment 31, this arrangement also having the effect of reducing noise. The deflections in the air guide duct 43 of the muffler 6 are small, therefore practically no flow noise occurs here. Furthermore, the operating noise of the air turbine 5 is significantly reduced by the muffler 6 that is arranged on the end of the air turbine 5, as a result no impairment to persons working with the spray gun 1 through excessive operating noise needs to be feared.

What is claimed is:

1. A spray gun (1) for atomizing paints, lacquers or similar media (3) that can be supplied to a workpiece by means of an air flow, wherein the spray gun (1) is actuated by means of a lever (15) mounted in a pivoting arrangement on a sleeve (11) which accommodates an atomizer nozzle (12), and the air flow is generated by an air turbine (5) assigned to the spray gun (1), wherein the air turbine (5) and an electric drive motor (4) are arranged substantially coaxially with the atomizer nozzle (12) of the spray gun (1) on a side of a handle (21) opposite to the sleeve (11) that carries the atomizer nozzle (12), so that the air flow from the air turbine (5) is supplied in a substantially straight line through the sleeve (11) of the atomizer nozzle (12), and wherein the air turbine (5) is provided with a muffler (6), and wherein a movement sequence of the lever (15) that actuates the spray gun (1) is adapted to operate a switch (22) associated with the drive motor (4) of the air turbine (5) and is influenced by the lever (15) in such a way that the drive motor (4) is switched on before the atomiser nozzle (12) opens and is switched off after the atomiser nozzle (12) closes.

2. The spray gun in accordance with claim 1, wherein the muffler (6), the air turbine (5) and the drive motor (4) are arranged axially one after the other in a direction of the air flow and are installed in an attachment (31) connected to the handle (21).

3. The spray gun in accordance with claim 2, wherein a cavity (7) is provided between the muffler (6) and the air turbine (5).

4. The spray gun in accordance with claim 2, wherein the attachment (31) that accommodates the muffler (6), the air turbine (5) and the drive motor (4), is arranged at an angle of from 0° to 60°, in relation to a longitudinal axis of the sleeve (11) that carries the atomiser nozzle (12), opposite to the handle (21).

5. The spray gun in accordance with claim 2, wherein the drive motor (4) of the air turbine (5) is equipped with a jacket (32) that is closed in an axial direction and radially supported in the attachment (31).

6. The spray gun in accordance with claim 5, wherein the jacket (32) is connected to the sleeve (11) with a connection that is adapted to be separated.

7. The spray gun in accordance with claim 5, wherein a protective grille (33) is arranged between the drive motor (4) of the air turbine (5) and the sleeve (11), the protective grille (33) being supported in the jacket (32).

8. The spray gun in accordance with claim 1, characterised in that an end of the handle (21) is disposed in a same plane as a standing surface of a reservoir container (2) attached to the spray gun (1) and is formed as a stand foot (30).

9. The spray gun in accordance with claim 1, wherein the muffler (6) forms an end of the air turbine (5) and is disposed in the intake area of the air turbine.

10. A spray gun (1) for atomizing paints, lacquers or similar media (3) that can be supplied to a workpiece by means of an air flow, wherein the spray gun (1) is actuated by means of a lever (15) mounted in a pivoting arrangement on a sleeve (11) which accommodates an atomizer nozzle (12) and the air flow is generated by an air turbine (5) assigned to the spray gun (1), wherein the air turbine (5) and an electric drive motor (4) are arranged substantially coaxially with the atomizer nozzle (12) of the spray gun (1) on a side of a handle (21) opposite to the sleeve (11) that carries the atomizer nozzle (12), so that the air flow from the air turbine (5) is supplied in a substantially straight line through the sleeve (11) of the atomizer nozzle (12), wherein the air turbine (5) is provided with a muffler (6), and wherein the muffler (6), the air turbine (5) and the drive motor (4) are arranged axially one after the other in a direction of the air flow and are installed in an attachment (31) connected to the handle (21); and wherein the drive motor (4) of the air turbine (5) is equipped with a jacket (32) that is closed in the axial direction and radially supported in the attachment (31); and wherein a protective grille (33) is arranged between the drive motor (4) of the air turbine (5) and the sleeve (11), the protective grille (33) being supported in the jacket (32); and wherein an end of the drive motor (4) of the air turbine (5) that faces away from the air turbine (5) is supported in the protective grille (33) which is manufactured from a vibration-damping material.

11. A spray gun (1) for atomizing paints, lacquers or similar media (3) that can be supplied to a workpiece by means of an air flow, wherein the spray gun (1) is actuated by means of a lever (15) mounted in a pivoting arrangement on a sleeve (11) which accommodates an atomizer nozzle (12), and the air flow is generated by an air turbine (5) assigned to the spray gun (1), wherein the air turbine (5) and an electric drive motor (4) are arranged substantially coaxially with the atomizer nozzle (12) of the spray gun (1) on a side of a handle (21) opposite to the sleeve (11) that carries the atomizer nozzle (12), so that the air flow from the air turbine (5) is supplied in a substantially straight line through the sleeve (11) of the atomizer nozzle (12), and in that the air turbine (5) is provided with a muffler (6), and wherein the muffler (6), the air turbine (5) and the drive motor (4) are arranged axially one after the other in a direction of the air flow and are installed in an attachment (31) connected to the handle (21); and wherein the drive motor (4) of the air turbine (5) is equipped with a jacket (32) that is closed in the axial direction and radially supported in the attachment (31); and wherein at least one of the attachment (31) and the jacket (32) are directly formed onto the handle (21) and, with a separable connection, on the sleeve (11) that carries the atomiser nozzle (12) by means of a bayonet lock (19, 20).

12. The spray gun in accordance with claim 11, wherein a container cover (26) is formed onto the sleeve (11) and wherein the container cover (26) is provided with a holding element (27) in the form of a lug to engage a web (28) projecting from the handle (21), in order to lock the connection between the at least one of the attachment (31) and the jacket (32), and the sleeve (11).

13. A spray gun (1) for atomizing paints, lacquers or similar media (3) that can be supplied to a workpiece by means of an air flow, wherein the spray gun (1) is actuated by means of a lever (15) mounted in a pivoting arrangement on a sleeve (11) which accommodates an atomizer nozzle (12), and the air flow is generated by an air turbine (5) assigned to the spray gun (1), wherein the air turbine (5) and an electric drive motor (4) are arranged substantially coaxially with the atomizer nozzle (12) of the spray gun (1) on a side of a handle (21) opposite to the sleeve (11) that carries the atomizer nozzle (12), so that the air flow from the air turbine (5) is supplied in a substantially straight line through the sleeve (11) of the atomizer nozzle (12), and wherein the air turbine (5) is provided with a muffler (6), and wherein the muffler (6), the air turbine (5) and the drive motor (4) are arranged axially one after the other in a direction of the air flow and are installed in an attachment (31) connected to the handle (21); and wherein the drive motor (4) of the air turbine (5) is equipped with a jacket (32) that is closed in the axial direction and radially supported in the attachment (31); and wherein a sound-absorbing insert (34) is arranged between the attachment (31) and the jacket (32) of the drive motor (4).

14. A spray gun (1) for atomizing paints, lacquers or similar media (3) that can be supplied to a workpiece by means of an air flow, wherein the spray gun (1) is actuated by means of a lever (15) mounted in a pivoting arrangement on a sleeve (11) which accommodates an atomizer nozzle (12), and the air flow is generated by an air turbine (5) assigned to the spray gun (1), wherein the air turbine (5) and an electric drive motor (4) are arranged substantially coaxially with the atomizer nozzle (12) of the spray gun (1) on a side of a handle (21) opposite to the sleeve (11) that carries the atomizer nozzle (12), so that the air flow from the air turbine (5) is supplied in a substantially straight line through the sleeve (11) of the atomizer nozzle (12), and in that the air turbine (5) is provided with a muffler (6), and wherein the muffler (6), the air turbine (5) and the drive motor (4) are arranged axially one after the other in a direction of the air flow and are installed in an attachment (31) connected to the handle (21); and wherein the muffler (6) of the spray gun (1) is provided with a spiral-shaped air duct (43) arranged in a housing (41) between an air inlet opening (44) and an air outlet opening (45), the air duct (43) being formed by two thin partition walls (47, 48) that extend in a spiral and are arranged at a lateral distance from one another on a selected one of a base (46) and a cover (42) of the housing (41) that is cylindrical in shape, and which project at right angles from the housing (41), the partition walls (47, 48) combining with the base (46) and the cover (42) to enclose a cross-sectional area (F), and wherein the air inlet opening (44) of the air guide duct (43) is disposed in a selected area of the outer wall of the housing (41) and the cover (42), in the form of slots, and wherein the air outlet opening (45) is arranged centrally in the housing (41) in the base (46) of the housing (41).

15. The spray gun in accordance with claim 14, wherein the air guide duct (43) comprises at least two sections (43*a*, 43*b*) mounted in a substantially mirror image arrangement to one another.

16. The spray gun in accordance with claim 15, wherein the two sections (43*a*, 43*b*) that form the air guide duct (43) are provided with a guide surface (49) in an area of the air outlet opening (45), the guide surface (49) being spatially curved.

17. The spray gun in accordance with claim 16, wherein the air guide duct sections (43*a*, 43*b*) in the area of the air outlet opening (45) are separated from one another by wall sections (51, 52) extending in an axial direction of the air guide duct (43).

18. The spray gun in accordance with claim 14, wherein a cross-sectional area (F, $F_1$) of the air guide duct (43) is consistent along the length thereof.

19. The spray gun in accordance with claim 18, wherein when the base (46) and/or the cover (42) of the housing (41) are configured with a funnel shape, the distance between the two partition walls (47, 48) enclosing the air guide duct (43) is continuously changed in such a way that an enclosed cross-sectional area (F) of the air guide duct (43) is constant at all times.

20. The spray gun in accordance with claim 14, wherein in the housing (41) with a tapered base (46), the air outlet opening (45) is followed by an air distributor (50) in the form of a guide body with a tapered configuration.

21. The spray gun in accordance with claim 14, wherein selected ones of the housing (41), the cover (42), and the partition walls (47, 48) are formed of plastic.

22. The spray gun in accordance with claim 21, wherein the selected ones of the housing (41), the cover (42), and the partition walls (47, 48) are formed from a plastic which absorbs or reflects sound, the plastic incorporating selected ones of air bubbles and pores.

23. The spray gun in accordance with claim 21, wherein the selected ones of the housing (41), the cover (42), and the partition walls (47, 48) are provided with a coating (55) which absorbs and/or reflects sound.

24. The spray gun in accordance with claim 14, wherein the partition walls (47, 48) that form the air guide duct (43) are formed onto the base (46) of the housing (41) and a seal (56) is disposed between them and the cover (42), the seal (56) corresponding approximately to the inner jacket surface of the cover (42).

25. The spray gun in accordance with claim 14, wherein air inlet openings (35) are provided in the form of slots in the attachment (31) of the spray gun (1), the air inlet openings (35) being arranged offset at a selected one of 90° and 180° in the circumferential direction and/or axially displaced in relation to the air inlet openings (44) disposed in the housing (41) and/or the cover (42) of the muffler (6).

* * * * *